US007118488B2

(12) United States Patent
Chan et al.

(10) Patent No.: US 7,118,488 B2
(45) Date of Patent: Oct. 10, 2006

(54) TRAINING PUTTER WITH LASER LINE PROJECTING DEVICE

(75) Inventors: Benny Chan, Fremont, CA (US); Suganda Jutamulia, Berkeley, CA (US); Chih Yen Liu, Saratoga, CA (US)

(73) Assignee: Newtonics Spectra Inc., Fremont, CA (US)

( * ) Notice: Subject to any disclaimer, the term of this patent is extended or adjusted under 35 U.S.C. 154(b) by 0 days.

(21) Appl. No.: 11/040,422

(22) Filed: Jan. 21, 2005

(65) Prior Publication Data

US 2006/0166753 A1 Jul. 27, 2006

(51) Int. Cl.
*A63B 69/36* (2006.01)

(52) U.S. Cl. ..... 473/220; 473/119

(58) Field of Classification Search ..... 473/219, 473/220, 221, 222, 223, 224, 225, 226
See application file for complete search history.

(56) References Cited

U.S. PATENT DOCUMENTS

| | | | | |
|---|---|---|---|---|
| 3,953,034 A | | 4/1976 | Nelson | 273/186 C |
| 5,029,868 A | | 7/1991 | Cloud | 273/186 C |
| 5,169,150 A | | 12/1992 | Tindale | 273/187.4 |
| 5,213,331 A | * | 5/1993 | Avanzini | 473/220 |
| 5,388,832 A | * | 2/1995 | Hsu | 473/220 |
| 5,435,562 A | * | 7/1995 | Stock et al. | 473/220 |
| 5,452,897 A | | 9/1995 | Mick | 273/186.2 |
| 5,611,739 A | * | 3/1997 | Carney | 473/220 |
| 5,709,609 A | | 1/1998 | Carney | 473/220 |
| 5,725,439 A | * | 3/1998 | Halsey et al. | 473/220 |
| 6,066,052 A | * | 5/2000 | Li | 473/220 |
| 6,371,864 B1 | | 4/2002 | Norwood | 473/220 |
| 6,383,087 B1 | | 5/2002 | Moser | 473/257 |
| 6,767,291 B1 | | 7/2004 | McCarthy | 473/220 |
| 6,796,910 B1 | | 9/2004 | Foster | 473/220 |

OTHER PUBLICATIONS

Thorlabs Catalog, vol. 15 (2003), p. 239.
Thesmartgolfer, Laser Putting Alignment System, Product Description (2004).
Redline Golf, LTS2000 Laser Training System, Product Description (2004).

* cited by examiner

*Primary Examiner*—Nini F. Legesse
(74) *Attorney, Agent, or Firm*—David Pressman

(57) ABSTRACT

A training putter with a laser line projecting device can be used for putting training to improve putting skill. The device is affixed to a putter head above its sweet spot, and emits a vertical light fan which projects a line on the around normal to the face of the putter head. The line is aligned with the sweet spot of the putter head and lies on the ground to connect the top of a golf ball with a target, such as a cup or a putting hole, so that alignment can be easily visualized. The device can be detached and reattached easily without any laser alignment. Furthermore, the device can be removably mounted to a user's own putter. The heat generated in the laser diode is quickly dissipated through the metal housing, the metal putter head, and the metal shaft to the surrounding air. Since proper operating temperature of the laser diode can be maintained, the laser diode will operate properly, which means the power of the emitted light will not be decreased, and the lifetime of the diode will not be shortened.

20 Claims, 7 Drawing Sheets

TRAINING PUTTER WITH LASER LINE PROJECTING DEVICE

CROSS-REFERENCE TO RELATED APPLICATION

Not applicable.

BACKGROUND—FIELD OF INVENTION

This invention relates to golf putting, specifically to an alignment device for training golfers to make more accurate putts.

BACKGROUND—DESCRIPTION OF PRIOR ART

Putting is a very important part of the game of golf. An important aspect in learning to be a good golfer is proper alignment of the putter head with the golf ball and the target, which is the putting hole. A large variety of devices have been proposed in the past for helping a golfer to improve his or her putting skill.

These include devices that employ lasers, usually laser diodes, for emitting a collimated beam from the putter head. These devices have been described in U.S. Pat. Nos. 5,169,150 to Tindale (1992) and U.S. Pat. No. 5,709,609 to Carney (1998), among others. U.S. Pat. No. 6,767,291 to McCarthy (2004) also teaches a similar method of directing a collimated beam from the center of a putter head to either a target screen or a golf ball. However, the beam cannot be directed to both the golf ball and the target at the same time. In another approach a mirror is fixed to a putter head to reflect a collimated beam emitted from a laser that is affixed to a target, as described in U.S. Pat. No. 5,452,897 to Mick (1995), or affixed to a reference point, as described in U.S. Pat. No. 6,383,087 to Moser (2002). In yet another approach, two parallel collimated laser beams are emitted from a putter head, as described in U.S. Pat. No. 5,029,868 to Cloud (1991). A training device based on a single collimated laser beam has been marketed by The Smart Golfer, Marblehead, Mass. (www.thesmartgolfer.com) (2004). The main drawback of these techniques is that the laser beam is not visible in the air; it is visible in a scattering medium only, e.g., fog. Thus the user cannot see the laser beam itself but will see only a bright point where the beam strikes a screen.

A bare laser diode spreads its light like a cone. When collimating lens is placed in front of such a diode, the emitted light is collimated. A new laser line projecting device, commonly called a "light-fan generator", "laser line generator", or simply a "line generator" has recently become available. It spreads the light from a laser diode like a flat wedge or handheld fan. I.e., the light-fan generator emits a sheet like or flat beam that is very flat in one direction perpendicular to the direction of propagation of the beam, but that expands from the source or generator at an angle that encompasses an ever widening dimension in a second direction perpendicular to the one direction and the direction of propagation. Thus, the line generator generates a light fan instead of a collimated beam. When the light fan strikes a screen or any surface, it projects a bright line instead of a point on the screen.

A light-fan generator can be built using the collimating and rod lenses shown in FIGS. 1A and 1B, which are side and top views of a light-fan generator. FIG. 1A shows light propagation in the x–z plane, where the z axis is the direction of light propagation and the x–y plane is perpendicular to the z axis. A laser diode 20 emits light that is collimated by a collimating lens 22. A rod lens 24 receives the collimated beam but does not affect the beam in x direction since lens 24 is parallel to the x axis. FIG. 1B is a top view of the arrangement of FIG. 1A which shows how the light propagates in the y–z plane after leaving lens 24. Rod lens 24 spreads the light in y direction and since it is collimated in x direction, it forms a light fan.

Another method for generating a light fan uses a special lens called a "line-generating lens", which has different focal lengths in x and y directions. I.e., the line-generating lens collimates light in one direction and spreads light in the other direction. FIG. 2A shows that the light emitted by laser diode 20 is collimated by a line-generating lens 26 in the x–z plane. FIG. 2B shows that the light emitted by laser diode 20 is expanded by line-generating lens 26 in the y–z plane. A line-generating lens can be purchased from Thorlabs, N.J. (item number LG-P4, shown at www.thorlabs.com).

FIG. 3 shows a training putter using the light-fan generator shown in FIGS. 1A and 1B, which has been marketed by Redline Golf, Yorba Linda, Calif. (www.redlinegolf.com) (2004). A light fan 38 is generated by light-fan generator 36, which is affixed to a shaft 30 of a putter 28. A line 40 is projected by light fan 38. The line is adjusted to pass a golf ball 34 and a "sweet spot" 49 on the striking face of a putter head 32. The sweet spot provides optimum response when it strikes the ball. The sweet spot is usually marked by a bar or bars, or a circle or circles, usually at the center of the face of the putter head, although some designs provide off-center sweet spots. Since the light fan comes from shaft 30, the light fan is not normal to the ground. Furthermore, although the beam from line generator 36 is directed downward to sweet spot 49, spot 49 is lower than golf ball 34. Thus, when the light fan strikes spot 49, it cannot strike the top 42 of golf ball 34. In other words, when golf ball 34 is aligned with sweet spot 49, line 40 cannot lie on both sweet spot 49 of putter head 32 and top 42 of ball 34. Line 40 centers on putter head 32 (half in front of and half behind the putter head). The spread of line 40 on the ground is short. When the putter is swung, line 40 may strike a wall or a vertical screen 44. It will form a slant line 46 on the wall or screen. This product has several drawbacks, namely:

1. When the laser line lies on the sweet spot of the putter head, it cannot lie on the top of the ball; thus it is difficult for a user to judge if the putter head and the ball are properly aligned.

2. The laser line on the ground is too short to connect the ball and a target (e.g., a cup to receive the ball); thus it is difficult for a user to judge if the putter head, the ball, and the target are properly aligned.

3. When the putter is swung, the light fan may strike a wall or a vertical screen, forming a slant line instead of a vertical line; thus it is difficult for a user to judge if the putter head is properly aligned.

4. The product has a plastic housing, which is detachably affixed to the shaft. The laser diode will become hot because the heat generated is not properly dissipated (plastic is not a good heat conductor). This will deteriorate the performance of the laser diode and cause the emitted light's brightness to decrease and the line's visibility to be low.

5. A user must mount and align the light-fan generator. It is not easy for an ordinary user who is inexperienced with laser alignment.

A similar arrangement using a laser affixed to the shaft of a putter has been described in U.S. Pat. No. 3,953,034 to Nelson (1976). The laser beam propagates parallel to the shaft until it is reflected by a convex mirror at the putter head, producing a light fan. The mirror is close to the shaft and not at the sweet spot of the putter head. The light fan strikes the ground, forming a bright line as a reference for putter alignment. The bright line is parallel to an imaginary line connecting the golf ball and a target, such as a cup. The drawbacks of this arrangement are:

1. The line projected on the ground does not connect the ball and the target; thus it is difficult for a user to judge if the putter head, the ball, and the target are properly aligned.

2. There is a distance between the laser at the shaft and the mirror at the putter head; thus it is difficult to maintain alignment between laser and mirror, especially after the putter is repeatedly swung.

An arrangement using a light-fan generator which is affixed to the putter head above the sweet spot is described in U.S. Pat. No. 6,371,864 to Norwood (2002). When the putter is properly aligned, the device projects a short vertical line on a screen above a target. The device does not project any line on the ground that connects the ball and the target. The drawbacks of this arrangement are:

1. No line is projected on the ground to connect the ball and the target; thus it is difficult for a user to judge if the putter head, the ball, and the target are properly aligned.

2. No laser heat dissipation issue is addressed; thus the laser may become hot and the emitted light brightness may decrease accordingly.

Another arrangement using a light-fan generator is described in U.S. Pat. No. 6,796,910 to Foster (2004). The light-fan generator is detachably connected to a putter shaft using a clamp. The light fan emitted from the generator is aligned to be normal to the ground and the putter head by two adjustments which must be performed by a user. In the first adjustment, the user rotates both a turret of a laser module and the clamp using a special alignment tool. The second adjustment is the rotation of the rod lens using a coin. However, this patent does not mention any procedure to position this vertical light fan over the sweet spot of the putter head. Thus, the extension of the projected line may not pass the sweet spot. The line is projected on the ground and a vertical bar, which is a target. However, the projected line does not necessarily pass the ball. The drawbacks of this arrangement are:

1. The line projected onto the ground does not pass the ball; thus it is difficult for a user to judge if the putter head, the ball, and the target are properly aligned.

2. It is difficult for an ordinary user to perform the laser alignment in two adjustments to get a vertical light fan.

3. The mechanical structures of the laser module employing the turret and the clamp are complex, which make it expensive to manufacture.

4. No laser heat dissipation issue is addressed; thus the laser may become hot and the emitted light's brightness may decrease accordingly.

To summarize, the prior art fails to teach the projection of a line on the ground that can connect the sweet spot, the top of the golf ball, and the target. Thus it is difficult for a user to judge if the putter head, the ball, and the target are properly aligned. The prior art also fails to provide a training putter which is simple to use without laser alignment. The prior art further fails to teach the dissipation of the heat generated by the laser diode to the putter in order to preserve or maintain the optimum operation of the laser diode and to maintain the desired brightness of the emitted light.

OBJECTS AND ADVANTAGES

Accordingly, several advantages of one or more aspects of the present invention are:

1. it provides an improved training putter with a light-fan generator which does not require laser alignment;

2. it projects a laser line that connects the sweet spot of a putter head, the top of a golf ball, and a target for putter alignment, which is needed in the training to improve putting skill;

3. it projects a vertical line onto a screen or wall for putter alignment, which is needed in training to improve putting skill;

4. it provides laser heat dissipation means to keep the laser emitting a high-brightness line;

5. it provides a training putter with a detachable light-fan generator which can be used during regulation play after the light-fan generator is removed; and 6. it provides a light-fan generator which can be mounted on a user's own putter and which projects a line that connects the sweet spot of a putter head, the top of a golf ball, and a target.

Further advantages of one or more aspects are the provision of a training putter which is simple to use and maintain and which is inexpensive to manufacture. Still further advantages will become apparent from a consideration of the ensuing description and drawings.

SUMMARY

In accordance with the invention, a light-fan generator is affixed to the top of a putter head above its sweet spot. The light-fan generator emits a vertical light fan normal to the face of the putter head and the ground so that the light fan projects a line on the ground that connects the sweet spot of the putter head, the top of a golf ball, and a target, such as a cup or a putting hole. Thus, the golfer can easily see when the putter head, the golf ball, and the target are aligned. Furthermore, the heat generated in the laser diode can be quickly dissipated through a metal housing to the metal putter head and the metal putter shaft to the surrounding air. The light-fan generator can also be mounted onto a user's own putter.

DRAWING FIGURES

REFERENCE NUMERALS IN DRAWINGS

| | | | |
|---|---|---|---|
| 20 | laser diode | 22 | collimating lens |
| 24 | rod lens | 26 | line-generating lens |
| 28 | putter | 30 | putter shaft |
| 32 | putter head | 34 | golf ball |
| 36 | light-fan generator | 38 | light fan |
| 39 | axis of light fan | 40 | projected line on ground |
| 42 | top of golf ball | 44 | wall or screen |
| 46 | projected line on wall or screen | 48 | laser line projecting device |
| 49 | sweet spot | 50 | screws |
| 52 | metal housing | 54 | rear housing |
| 56 | target | 58 | switch |
| 60 | battery holder | 62 | batteries |
| 64 | battery holder cap | 66 | wires |
| 68 | front brackets | 70 | threaded attachment |
| 72 | opposing screw | | |

FIG. 4—DESCRIPTION AND OPERATION

Figure 4:
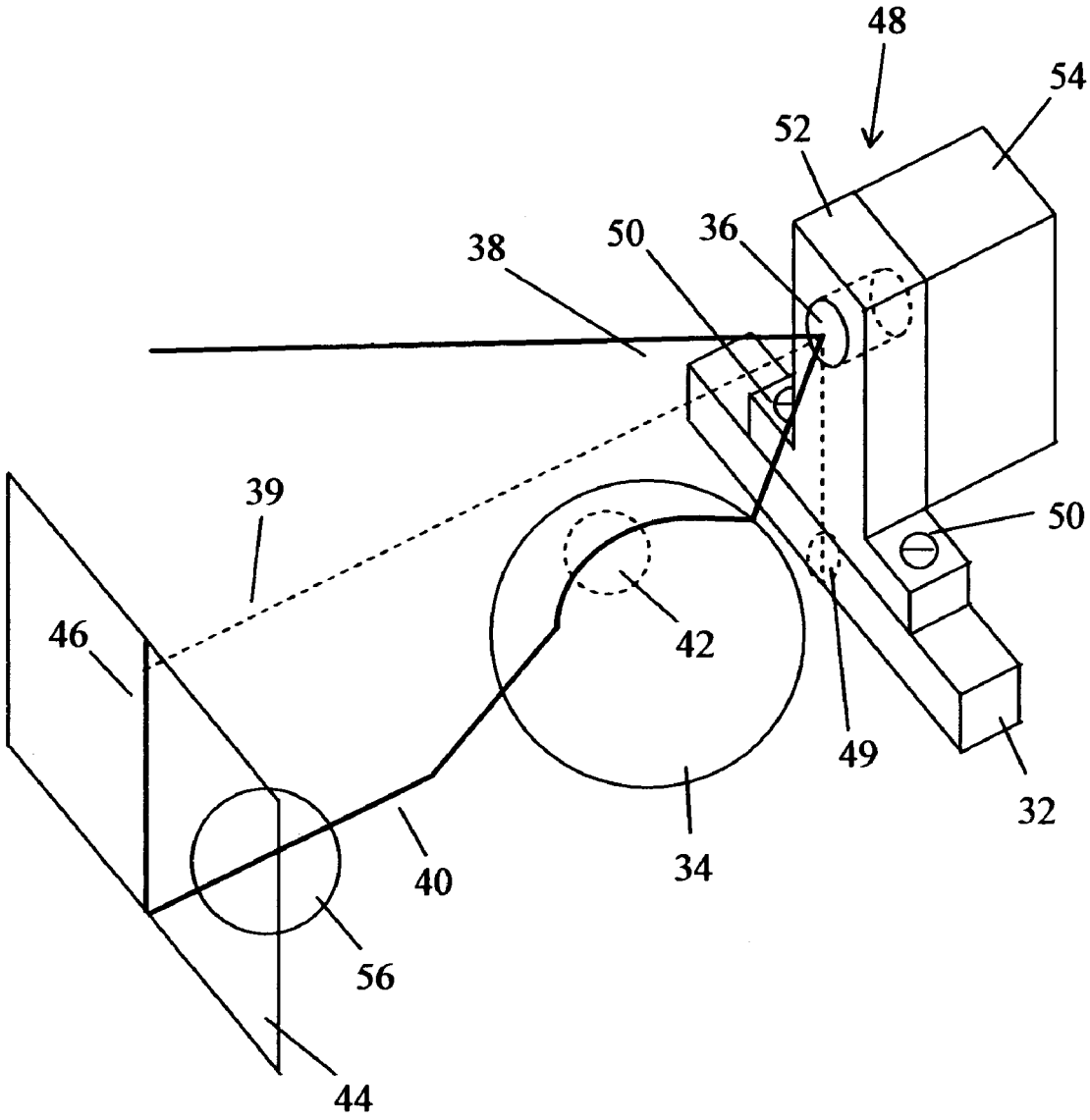
FIG. 4 shows a preferred embodiment of the laser line projecting device affixed to a putter head in accordance with the invention.

FIG. 4 shows a preferred embodiment of a training putter with a laser line projecting device in accordance with the invention. A laser line projecting device 48 is affixed to the top of a putter head 32 above its sweet spot 49 using glue, a screw, or a plurality of screws 50. Device 48 comprises a first metal housing 52 that holds a laser line or light-fan generator 36, and a rear housing 54. Generator 36 emits a vertical light fan 38 and is shown as a cylinder which is parallel to the ground but normal to the striking face of putter head 32.

Figure 1A:
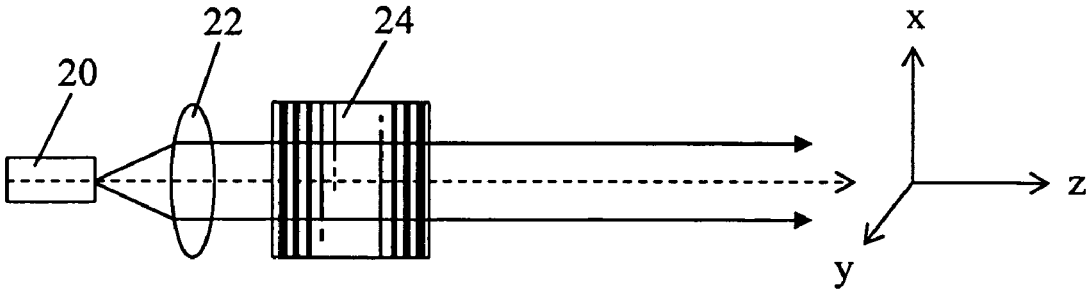
PRIOR ART Fig. 1A
FIGS. 1A and 1B show side and top views of a prior-art light-fan generator using a collimating lens and a rod lens.
Figure 1B:
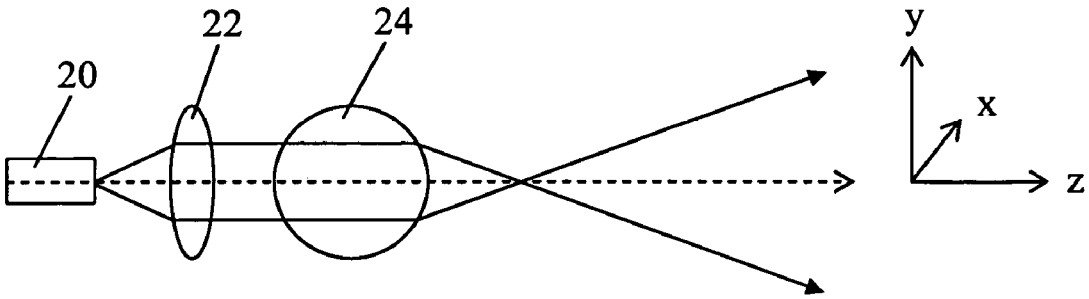
PRIOR ART Fig. 1B
Figure 2A:
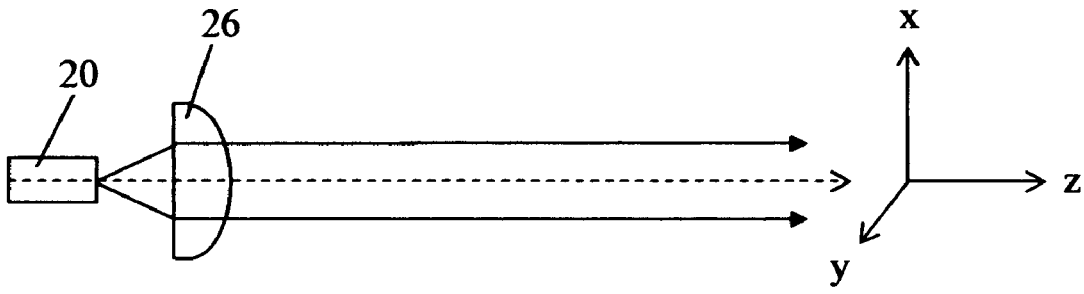
PRIOR ART Fig. 2A
FIGS. 2A and 2B show a prior-art light-fan generator using a line-generating lens.
Figure 2B:
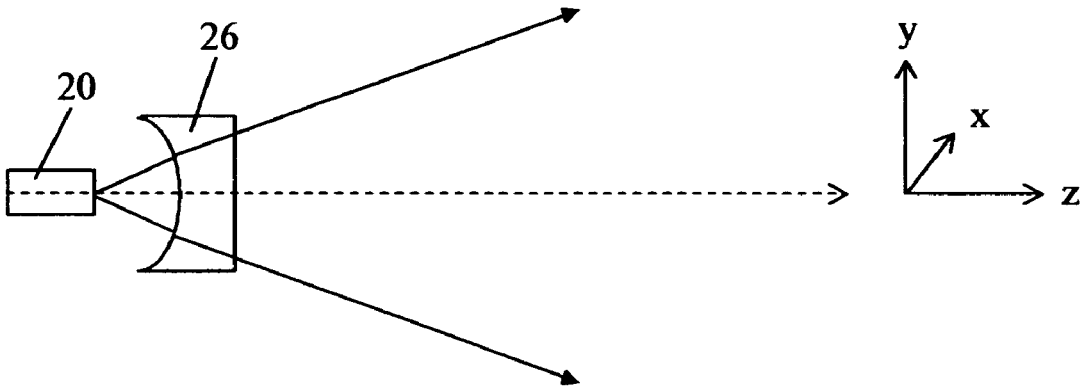
PRIOR ART Fig. 2B
Figure 3:
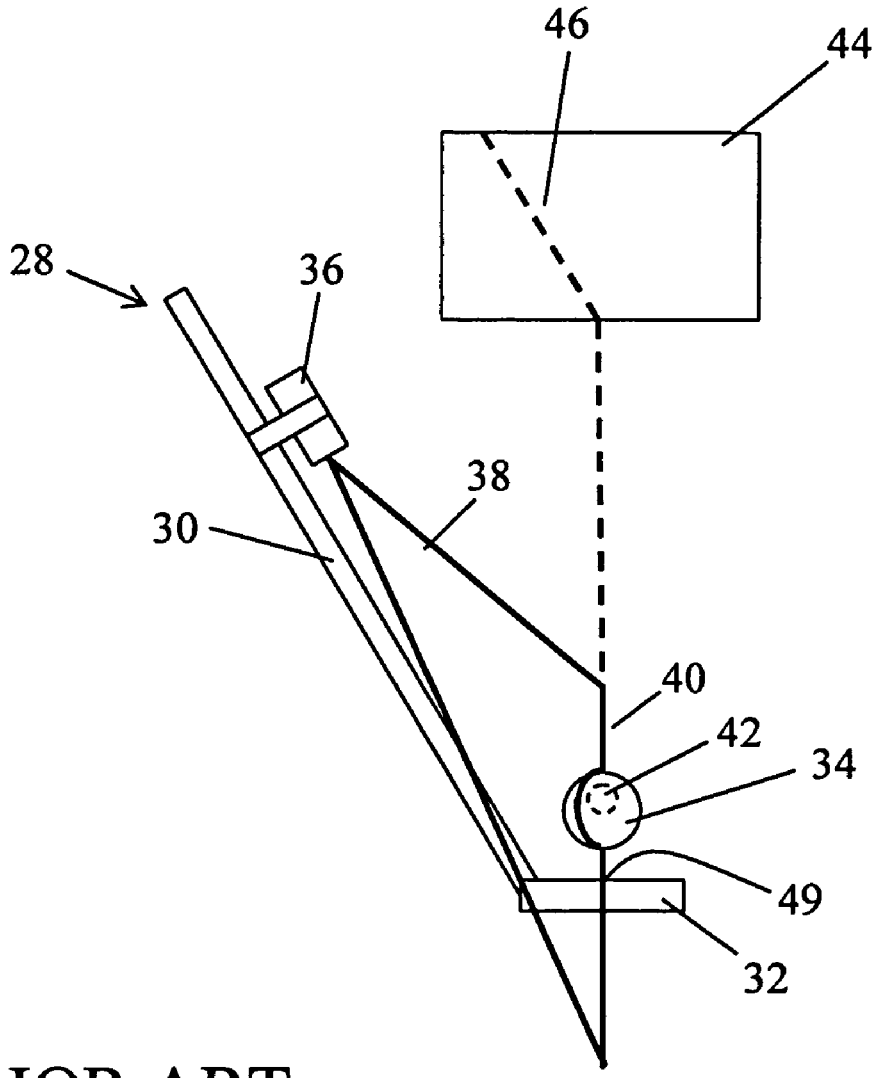
PRIOR ART Fig. 3
FIG. 3 shows a prior-art training putter using a light-fan generator affixed to a putter shaft.
Figure 5:
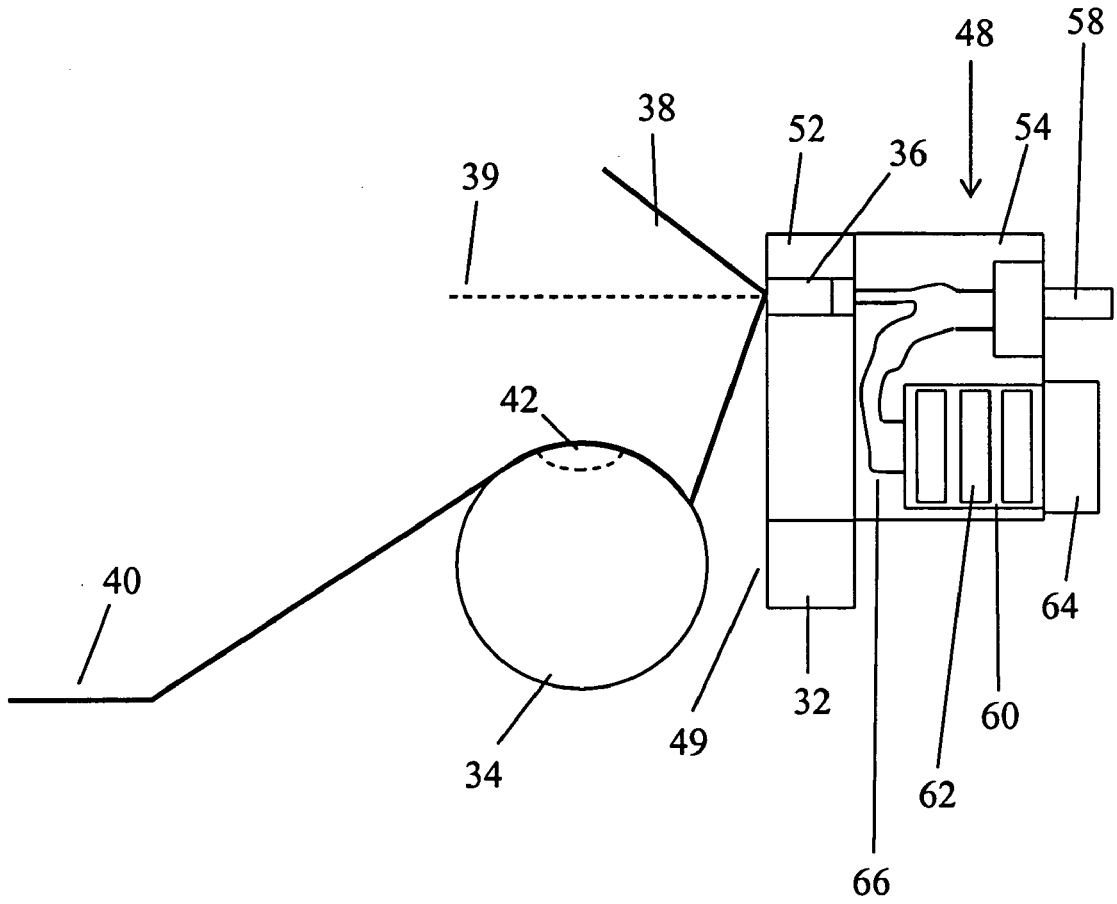
FIG. 5 shows some parts in the housing of a preferred embodiment of the laser line projecting device shown in FIG. 4.
Figure 6:
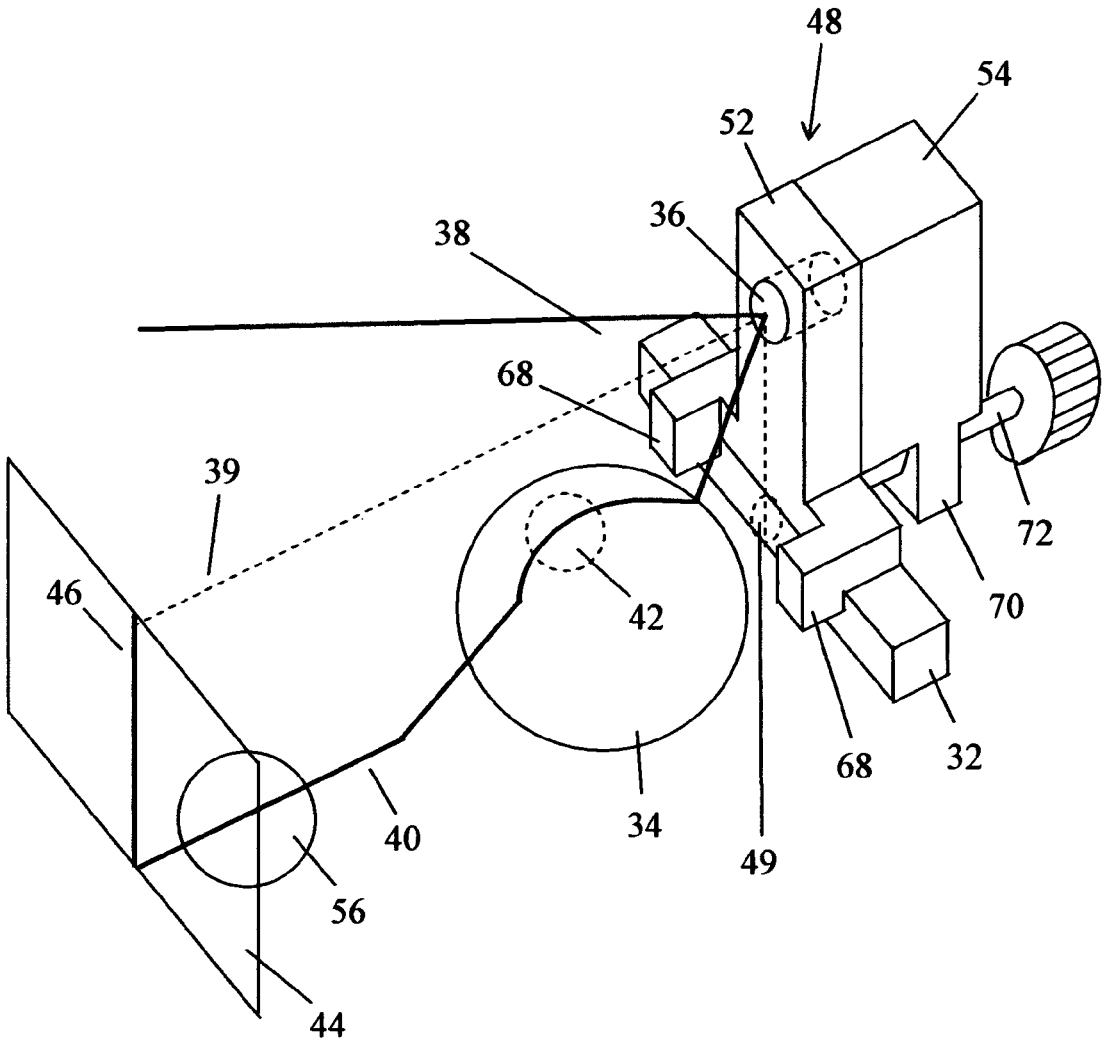
FIG. 6 shows a preferred embodiment of the laser line projecting device that can be removably mounted on a user's own putter in accordance with the invention.

Consequently, an axis 39 of light fan 38 is also parallel to the ground but normal to the face of putter head 32. In this way, generator emits a vertically oriented fan- or wedge-shaped beam. As shown in FIGS. 4 to 6, the beam is wide enough to project a line on the ground 40, normal to the face of putter head 32, and the top 42 of a golf ball 34 placed in front of the putter. This line extends indefinitely along ground 40. Light fan generator 36 comprises (FIGS. 1A and 1B) laser diode 20, collimating lens 22, and rod lens 24, or laser diode 20 and line-generating lens 26 shown in FIGS. 2A and 2B. Preferably the laser diode emits light with a power 5 mW or less (class IIIA) and a wavelength of 635 nm or 650 nm (red color).

The operation of laser diodes is very sensitive to temperature. A laser diode chip emits light by injecting electric current through it. The light generation in the laser diode chip is a process related to quantum physics that also generates heat. Thus, the chip is heated when electric current flows through it. The rising temperature of the chip in turn affects the light generation process in the chip, resulting in a decrease in output optical power. Furthermore, the rising temperature will also shorten the lifetime of the laser diode or even destroy it. Therefore, without properly cooling the diode, the emitted light will dim as the temperature rises, and its lifetime will be shortened accordingly.

In the present training putter, light-fan generator 36 is held by metal housing 52, which is connected to a chip (not shown) inside. Housing 52 is affixed to putter head 32, and head 32 is further connected to the putter's metal shaft (not shown). In this way, the heat generated by the chip will be easily dissipated through the metal putter head and the metal shaft to the surrounding air. Therefore, the light-fan generator will produce a line with constant high brightness, and its lifetime will not be shortened as much.

Light-fan 38 emitted by generator 36 is normal to the ground, and also normal to the face of putter head 32. By affixing device 48 to putter head 32 above its sweet spot 49, the plane of the vertical light fan intersects putter head 32 at the sweet spot. Projected line 40 on the ground is normal to the face of putter head 32. A proximal extension or projection of line 40 intersects putter head 32 at sweet spot 49. In putting training, a player can align the training putter until projected line 40 passes both top 42 of golf ball 34 and a target 56, which can be a cup to receive the ball or a putting hole.

Since the plane of the vertical light fan intersects sweet spot 49, line 40 is aligned with three objects: (1) sweet spot 49 of putter head 32, (2) top 42 of ball 34, and (3) target 56. Although line 40 does not actually intersect sweet spot 49, the proximal extension of line 40 does intersect sweet spot 49. Furthermore, since light fan 38 is normal to the ground, the opposite or distal extension of line 40 is long enough to lie on a wall or a screen 44 to form a vertical line 46. If line 46 on wall or screen 44 is slanted, it indicates that the putter is not in proper alignment, i.e., light fan 38 is not normal to the ground. To align the putter in practice, a player connects top 42 of ball 34 to target 56 using line 40, and adjusts the putter to project a vertical line 46 on the wall or screen.

The present putter alignment device is simpler and superior to of the Norwood device since the present device does not use a second light source, a light-emitting diode (LED), or a second aperture at the top of the device for aligning the putter. The user can align the device without looking at any LED through any second aperture while they adjust the putter to make a short line on a screen vertical. The present device is also superior since it enables the golfer to align the putter by simply adjusting it so that projected line 40 lies on the ground and connects top 42 of ball 34 with target 56.

The present putter alignment device is an important contribution to putting training. A training putter can be used, however, only in practice and not during regulation play. Device 48 can be detached by unscrewing screws 50, so that a player can use the putter in regulation play after device 48 is removed. Unlike the device described in Foster, supra, which needs two adjustments to form a vertical light fan and has no facility for positioning the light fan over the sweet spot, device 48 can be detached and reattached simply without any laser alignment. All required laser alignments have been completed in the factory.

FIG. 5—DESCRIPTION AND OPERATION

FIG. 5 shows additional details of the device of FIG. 4. Rear housing 54 encloses a switch 58 and a battery holder 60. Battery holder 60 holds batteries 62 and has a cap 64. Light-fan generator 36, switch 58, and battery holder 60 are connected in series by wires 66. When switch 58 is turned on, generator 36 emits a vertical light fan 38 which projects line 40 on the top of ball 42 and onto the ground so that line 40 is on the ground and is normal to putter head 32. Rear housing 54 can be made from metal or other materials such as plastic, since it has no role in the heat dissipation process.

FIG. 6—DESCRIPTION AND OPERATION

FIG. 6 shows a preferred embodiment of the laser line projecting device that can be removably mounted to a user's own putter according to the invention. Device 48 is mounted on putter head 32 on the top of its sweet spot 49 using an adaptor, including a pair of front brackets 68 extending from metal housing 52. Brackets 68 press against the front surface of putter head 32. An opposing screw 72 presses against the back surface of putter head 32. Screw 72 is threaded through a threaded attachment 70 to rear housing 54. In this way, device 48 can be easily mounted to and removed from a putter, which is selected and preferred by a player.

Device 48 is affixed to putter head 32 on the top of sweet spot 49. The space between two front brackets 68 is wide enough to let putter head 32 strike ball 34 at sweet spot 49. When the switch is turned on, light-fan generator 36 emits light fan 38 and projects line 40, which is normal to putter head 32 and lies on the ground to connect top 42 of golf ball 34 with target 56.

FIG. 7—DESCRIPTION AND OPERATION

Figure 7:
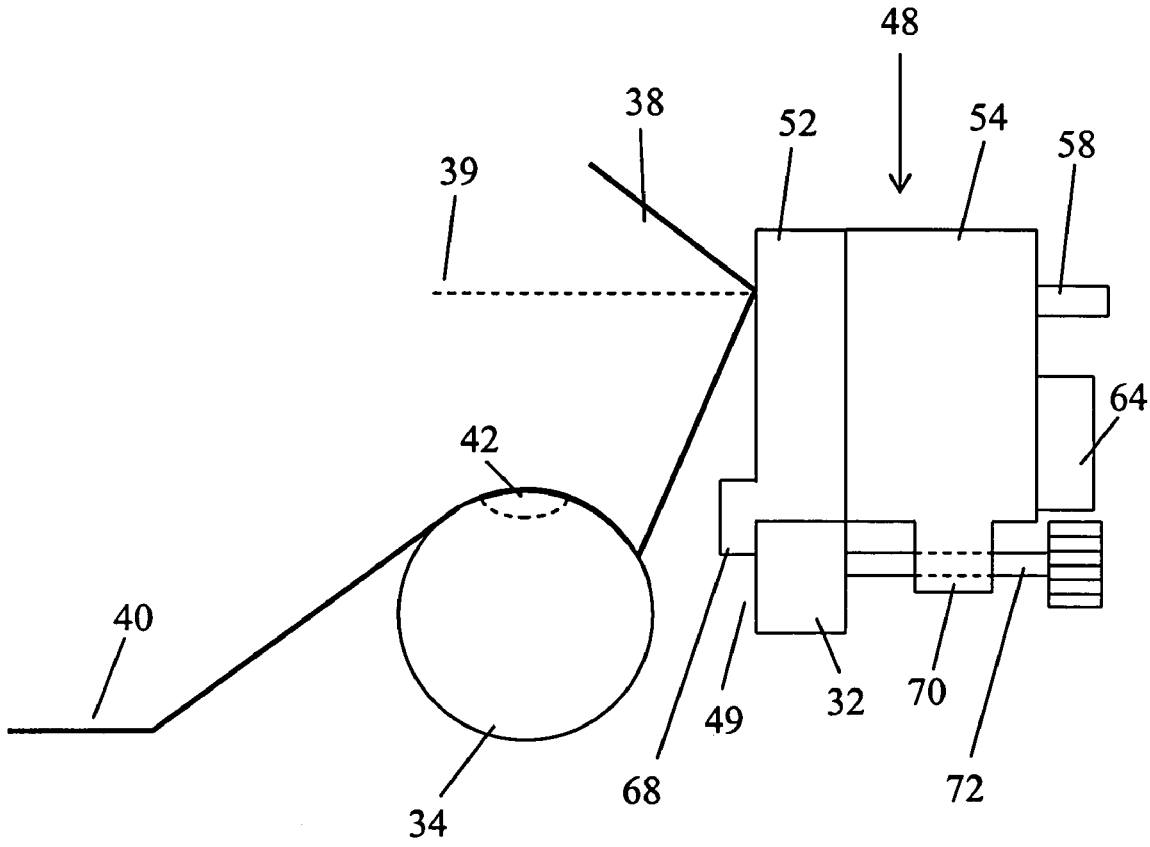
FIG. 7 shows a side view of a preferred embodiment of the laser line projecting device shown in FIG. 6.

FIG. 7 is a side view of a preferred embodiment of the laser line projecting device shown in FIG. 6. Brackets 68 mate with the front surface of putter head 32. Opposing screw 72 is threaded through threaded attachment 70. Brackets 68 and screw 72 affix device 48 to putter head 32. In this way, device 48 can be easily mounted to or removed from head 32 of a user's own putter.

CONCLUSION, RAMIFICATIONS, AND SCOPE

Accordingly, the reader will see that a putter can be used with the laser line projecting device for putting training to improve putting skill. By turning on the switch, the device emits a vertical light fan that is normal to the putter head and projects a line onto the ground which connects the top of a golf ball with the target. Therefore the alignment of the putter, the ball, and the target can be clearly visualized. Furthermore the device can be detached and reattached easily without aligning a laser.

The heat generated in the laser diode is quickly dissipated through the metal housing, the metal putter head, and the metal shaft to the surrounding air. Since the proper operating temperature of the laser diode can be maintained, the laser diode will operate properly, which means the power of the emitted light will not be decreased, and its lifetime will not be shortened.

Furthermore, the laser line projecting device can be mounted on the head of a user's own putter using mounting means, for example, an adaptor including a pair of front brackets and an opposing screw that is threaded through a threaded attachment to the device.

Although the description above contains many specificities, these should not be construed as limiting the scope of the invention but as merely providing illustrations of some of the presently preferred embodiments of this invention. Other embodiments are possible. For example:

- Light-fan generator 36 in metal housing 52 can be tilted toward or away from the ground (not parallel to the ground).
- A stop can be included in light-fan generator 36 to control the angle of the light fan. The aperture of the stop can be symmetric or asymmetric such that the upper half of the fan angle is smaller or larger than the lower half of the fan angle.
- Light-fan generators different from the prior-art ones illustrated in FIGS. 1A, 1B, 2A, and 2B can be used. Light-fan generators using holographic or diffraction optical elements can be used to generate a vertical light fan and to project a line on the ground.
- Light-fan generator 36 may emit light of any color.
- The batteries and switch can be attached to the shaft instead of the putter head.
- The target can be a simple cup or a complex ball receiver with electronic sensors.
- The laser line projecting device can be mounted using a magnetic adaptor, a hook-and-loop fastener, or other removable mounting means.
- Heat dissipation will not be required if laser diodes that either generate less or no heat, or can operate at high temperature, are available.

Thus the scope of the invention should be determined by the appended claims and their legal equivalents, rather than by examples given.

The invention claimed is:

1. A training device for training a golfer to use a putter of the type comprising an elongated shaft and a putter head attached to a bottom head of said shaft, where said putter head (a) comprises a striking face that (1) has a sweet spot and (2) is normally generally vertically oriented when said putter is held for use, and (b) has a top adjacent and above said striking surface, said training device comprising:

(a) a housing having means for mounting said housing on said putter, (b) said housing including a laser fan generator for emitting a vertically oriented laser fan beam in a direction normal to said striking face of said putter head when said housing is mounted on said top of said putter head, (c) said laser fan beam being divergent enough in the vertical direction to project a line of light on (1) a golf ball placed in front of said striking face, (2) a target on the ground spaced away from said golf ball and said striking face, and (3) the ground between said golf ball and said target, such that said laser fan beam projects said line of light to connect said golf ball, said ground, and said target when said putter is held by said golfer in alignment with said golf ball and said target, (d) whereby a golfer can align said putter so that said line of light projected by said laser fan generator connects said golf ball and said target and can be aligned with said sweet spot of said putter head, so that said golfer will thereby hold said putter in a more optimum orientation.

2. The training device of claim 1 wherein said housing device is made of metal and said laser fan generator uses a laser diode to emit said vertical light fan and to project said line on the ground, and where said metal housing includes a rear housing enclosing a switch, a battery holder, and wires for connecting said line generator, said switch and said battery holder in series.

3. The training device of claim 2 wherein said metal housing is affixed to said putter using a screw or a plurality of screws.

4. The training device of claim 2 wherein said metal housing is affixed to said putter with an adhesive.

5. The training device of claim 1 wherein said laser fan beam is red.

6. The training device of claim 1 wherein said housing is removably affixed to said putter using a screw clamping arrangement.

7. The training device of claim 1 wherein said housing is removably affixed to said putter head.

8. The training device of claim 7 wherein said housing is removably affixed to said top of said putter head.

9. A training device for training a golfer to use a putter of the type comprising an elongated shaft and a putter head attached to a bottom end of said shaft, where said putter head (a) comprises a striking face that (1) has a sweet spot and (2) is normally generally vertically oriented when said putter is held for use, and (b) has a top adjacent and above said striking face, said training device comprising:

(a) a housing, (b) means for removably mounting said housing on said putter, (c) said housing including a laser fan generator for projecting a vertically oriented laser fan beam in a direction normal to said striking face of said putter head when said housing is mounted on said top of said putter head, (d) said means for removably mounting said housing on said putter arranged to mount said housing so that said vertically oriented laser fan beam can be aligned with said sweet spot, (e) said laser fan beam being divergent enough in the vertical direction to project a line of light on (1) a golf ball placed in front of said striking surface, (2) a target on the ground spaced away from said golf ball and said striking surface, and (3) the ground between said golf ball and said target, such that said laser fan beam projects said line of light to connect said golf ball, said ground, and said target when said putter is held by said golfer in alignment with said golf ball and said target, (f) whereby a golfer can align said putter so that said line of light projected by said laser fan generator connects said golf ball and said target and can be aligned with said sweet spot of said putter head, so that said golfer will thereby hold said putter in a more optimum orientation.

10. The training device of claim 9 wherein said means for removably mounting said housing is arranged to removably mount said housing onto said putter head.

11. The training device of claim 10 wherein said means for removably mounting said housing is arranged to removably mount said housing onto said face of said putter head.

12. The training device of claim 11 wherein said means for removably mounting is an adapter comprising a pair of front brackets arranged to mate with said striking surface of said putter head, an opposing screw for adjustably pressing against a back surface of said putter head, and a threaded attachment on said housing for holding said opposing screw.

13. The training device of claim 9 wherein said housing is made of metal, said laser fan generator uses a laser diode to emit said vertical light fan, and includes a rear housing enclosing a switch, a battery holder, and wires for connecting said line generator, said switch and said battery holder in series.

14. The training device of claim 9 wherein said laser fan beam is red.

15. A method for enabling a golfer to align a putter in putting training, comprising:

(a) providing a golf putter having a putter head, (b) providing a housing on said putter, (c) providing in said housing a laser fan generator for projecting a vertically oriented laser fan beam in a direction normal to a striking face of said putter head, said laser fan beam being divergent enough in the vertical direction to strike (1) a golf ball placed in front of said striking face, (2) a target on the ground spaced away from said golf ball and said striking face, and (3) the ground between said golf ball and said target, such that said laser fan beam projects a line of light on said golf ball, said ground, and said target when said putter is held by said golfer in alignment with said golf ball and said target, and (d) aligning said putter so that said line of light projected by said laser fan generator connects said golf ball and said target and an extension of said line of light is aligned with a sweet spot of said putter head, (e) whereby said golfer will hold said putter in a more optimum orientation.

16. The method of claim 15 wherein said housing is mounted on a top surface of said putter head with an adapter comprising a pair of front brackets for mating with said striking surface of said putter head, an opposing screw for adjustably pressing against a back surface of said putter head, and a threaded attachment on said housing for holding said opposing screw.

17. The method of claim 15 wherein said housing is made of metal, said laser fan generator uses a laser diode to emit said vertical light fan, and includes a rear housing enclosing a switch, a battery holder, and wires for connecting said line generator, said switch and said battery holder in series.

18. The method of claim 15 wherein said housing device is made of metal and said laser fan generator uses a laser diode to emit said vertical light fan and to project said line on the ground, and where said metal housing includes a rear housing enclosing a switch, a battery holder, and wires for connecting said line generator, said switch and said battery holder in series.

19. The method of claim 18 wherein said metal housing is affixed to said putter using a screw or a plurality of screws.

20. The method of claim 18 wherein said metal housing is affixed to said putter with an adhesive.

* * * * *

UNITED STATES PATENT AND TRADEMARK OFFICE

CERTIFICATE OF CORRECTION

PATENT NO. : 7,118,488 B2
APPLICATION NO. : 11/040422
DATED : October 10, 2006
INVENTOR(S) : B. Chan, S. Jutamulia and C.Y. Liu It is certified that error appears in the above-identified patent and that said Letters Patent is hereby corrected as shown below:

On Title page, item 57

Abstract

Col. 1, line 4 change “around” to --ground--

Signed and Sealed this

Twelfth Day of December, 2006

JON W. DUDAS
*Director of the United States Patent and Trademark Office*